US009828571B2

(12) United States Patent
Britton

(10) Patent No.: US 9,828,571 B2
(45) Date of Patent: Nov. 28, 2017

(54) HEAVY DUTY LAUNDRY DETERGENT

(71) Applicant: ILLINOIS TOOL WORKS, INC., Glenview, IL (US)

(72) Inventor: Claudia E. Britton, Aurora, OH (US)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 0 days.

(21) Appl. No.: 15/089,684

(22) Filed: Apr. 4, 2016

(65) Prior Publication Data

US 2017/0313958 A1 Nov. 2, 2017

Related U.S. Application Data

(60) Provisional application No. 62/171,850, filed on Jun. 5, 2015.

(51) Int. Cl.

| | |
|---|---|
| ***C11D 1/22*** | (2006.01) |
| ***C11D 1/66*** | (2006.01) |
| ***C11D 3/00*** | (2006.01) |
| ***C11D 3/386*** | (2006.01) |
| ***C11D 3/20*** | (2006.01) |
| ***C11D 3/04*** | (2006.01) |
| ***C11D 3/30*** | (2006.01) |
| ***C11D 3/37*** | (2006.01) |

(52) U.S. Cl.

CPC ..... *C11D 3/0036* (2013.01); *C11D 1/22* (2013.01); *C11D 1/66* (2013.01); *C11D 3/046* (2013.01); *C11D 3/2086* (2013.01); *C11D 3/30* (2013.01); *C11D 3/3757* (2013.01); *C11D 3/38645* (2013.01)

(58) Field of Classification Search

CPC ..... C11D 3/22; C11D 1/22
USPC ..... 510/300
See application file for complete search history.

(56) References Cited

U.S. PATENT DOCUMENTS

| | | | | | |
|---|---|---|---|---|---|
| 3,951,826 | A | | 4/1976 | Rasmussen | |
| 4,116,885 | A | * | 9/1978 | Derstadt | C11D 1/146 510/299 |
| 4,144,266 | A | | 3/1979 | Plummer et al. | |
| 4,210,417 | A | * | 7/1980 | McClain | D06M 15/423 510/299 |
| 4,246,495 | A | | 1/1981 | Pressman | |
| 4,721,580 | A | * | 1/1988 | Gosselink | C07C 309/00 427/242 |
| 4,790,856 | A | | 12/1988 | Wixon | |
| 5,182,043 | A | * | 1/1993 | Morrall | C08G 63/672 510/299 |
| 5,256,168 | A | * | 10/1993 | Morrall | C08G 63/672 427/393.4 |
| 5,565,135 | A | | 10/1996 | Dauderman et al. | |
| 5,786,318 | A | | 7/1998 | Blokzijl et al. | |
| 5,789,365 | A | | 8/1998 | Blokzijl et al. | |
| 5,789,366 | A | | 8/1998 | Blokzijl et al. | |
| 5,789,367 | A | | 8/1998 | Blokzijl et al. | |
| 5,863,877 | A | | 1/1999 | Carr et al. | |
| 6,020,303 | A | * | 2/2000 | Cripe | A61K 8/463 510/235 |
| 6,153,723 | A | * | 11/2000 | Lang | C11D 3/0031 510/108 |
| 6,225,278 | B1 | | 5/2001 | Detering et al. | |
| 6,235,704 | B1 | | 5/2001 | Detering et al. | |
| 6,770,581 | B1 | * | 8/2004 | DeMott | A47G 23/03 428/91 |
| 6,838,419 | B2 | | 1/2005 | Pereira et al. | |
| 8,709,168 | B2 | | 4/2014 | Waite et al. | |
| 2003/0104969 | A1 | * | 6/2003 | Caswell | A47F 1/08 510/513 |
| 2004/0072704 | A1 | * | 4/2004 | Gerke | A61K 8/585 510/101 |
| 2005/0098759 | A1 | * | 5/2005 | Frankenbach | D06M 7/00 252/8.91 |
| 2007/0000067 | A1 | | 1/2007 | Shi et al. | |
| 2012/0231987 | A1 | * | 9/2012 | Britton | C11D 1/83 510/138 |
| 2014/0011726 | A1 | | 1/2014 | Mitchell et al. | |

FOREIGN PATENT DOCUMENTS

| | | | | |
|---|---|---|---|---|
| EP | 2535401 | A1 | 12/2012 | |
| WO | 9743374 | A1 | 11/1997 | |
| WO | 0123515 | A1 | 4/2001 | |
| WO | 2013087284 | A1 | 6/2013 | |
| WO | 2013092049 | A1 | 6/2013 | |
| WO | WO 2013087284 | A1 * | 6/2013 | C11D 1/83 |

* cited by examiner

*Primary Examiner* — Nicole M Buie-Hatcher
*Assistant Examiner* — M. Reza Asdjodi
(74) *Attorney, Agent, or Firm* — Avery N. Goldstein; Blue Filament Law PLLC

(57) ABSTRACT

A laundry detergent formulation is provided that is formed as an aqueous blend of surfactants, enzymes, builders, and soil release polymers to inhibit soil re-deposition back onto other clothing or elements of the washing machine. The detergent formulation also contains additives with properties that impart a treatment to fabrics that inhibits future soil deposition onto the clothing with continued use. The detergent formulation provides cleaning of heavy duty grease and automotive soils from clothing surfaces that is superior to current detergent products.

11 Claims, 2 Drawing Sheets

HEAVY DUTY LAUNDRY DETERGENT

CROSS REFERENCE TO RELATED APPLICATIONS

This application claims priority benefit of U.S. Provisional Application Ser. No. 62/171,850 filed 5 Jun. 2015; the contents of which are hereby incorporated by reference.

FIELD OF THE INVENTION

The present invention in general relates to cleaning compositions and in particular, to a heavy duty cleaning composition for removal of heavy duty grease and automotive soils from clothing while imparting anti soil re-deposition properties such that lifted soil does not redeposit back onto other clothing or a mechanical washing unit.

BACKGROUND OF THE INVENTION

Laundry detergent is a cleaning agent that is added to washing machines to remove dirt from clothing. Soap has largely been displaced by branched alkylbenzenesulfonates as the main cleaning agent in laundry detergents as soap is relatively ineffective in hard water. However, branched alkylbenzenesulfonates have been found to have poor biodegradable properties, and are often replaced with linear alkylbenzenesulfonates (LABs), as more biodegradable than the branched analogs. Surfactants are often classified according to the charge of the molecule or ion, the three main classes being anionic, neutral, and cationic detergents. Anionic detergents are most commonly encountered for domestic laundry detergents. The polar component allows the detergent to dissolve in the water, whereas the nonpolar portion solubilizes greasy ("hydrophobic") materials that are the usual target of the cleaning process.

Detergent formulations, which describe an entire detergent product besides just the surfactants, generally contain several components. Three main ingredients of common detergent formulations are builders (50% by weight, approximately), the alkylbenzenesulfonate surfactant (15%), and bleaches (7%). Builders are water softeners, whose chemical compounds are agents that remove calcium ions by complexation or precipitation. Typical builders are sodium carbonate, complexation agents, soap, and zeolites. Builders function by sequestering or precipitating the problematic ions. One of the most common builders is sodium triphosphate, yet sodium triphosphate induces standing water eutrophication. Bleach refers to a number of chemicals which remove color, whiten, or disinfect, often by oxidation. Most bleaches in laundry detergents are oxidizers, e.g., sodium perborate or sodium hypochlorite. In addition, other agents are added as "bleach activators", to enhance the effectiveness of the bleaching agent; a popular bleach activator is tetraacetylethylenediamine. Enzymes are macromolecular biological catalysts. Enzymes accelerate, or catalyze, chemical reactions. The amounts of enzyme typically may be up to about 2% by weight of a detergent product, and are required to degrade recalcitrant stains composed of proteins, fats, or carbohydrates, where each type of stain requires a different type of enzyme, i.e., protease for proteins, lipases for greases, and amylases for carbohydrates.

Detergent formulations include many other ingredients depending on the specific application. Such additives modify the foaming properties of the detergent product by either stabilizing or counteracting foam. Other ingredients increase or decrease the viscosity of the solution, or solubilize other ingredients. Corrosion inhibitors counteract damage to washing equipment. Dye transfer inhibitors act to prevent dyes from one article from coloring other items. Anti-redeposition agents are used to prevent fine soil particles from reattaching to the product being cleaned. In addition, a number of ingredients affect aesthetic properties of the item to be cleaned, or the detergent itself before or during use. These agents include optical brighteners, fabric softeners, and colorants. A variety of perfumes are also components of modern detergents, provided that the perfumes are compatible with the other components and do not affect the color of the cleaned item.

In spite of the range of detergent formulations that have been developed, it remains a problem that consumer washing machines using conventional detergents are ill-equipped to contend with heavy grease stained clothing. Typical conventional detergent formulations either fail to remove the grease in a single wash cycle or suffer from re-deposition of the grease onto the components of the washing machine such as the drum from which the grease can transfer to a next load of clothes placed in the washing machine.

While there are many types of detergents available, there still exists a need for a detergent formulation for heavy duty grease stains and automotive soils that leave clothing clean while preventing the re-deposition of removed soiling material from clothing or on the washing unit itself.

SUMMARY OF THE INVENTION

A heavy duty detergent formulation for washing clothing in a washing machine includes one or more builders, one or more enzymes, one or more surfactants, a solvent, a biocide, and a soil release polymer present from 0.6 to 5.5 total weight percent, where the soil release polymer imparts anti soil re-deposition properties so that soil does not redeposit back onto the clothing or the washing machine once soil is removed from the clothing. Water forms a majority of the composition such that the composition is monophasic for at least 4 months of storage at 20° Celsius.

A process for the use of the heavy duty detergent formulation for washing clothing in a washing machine is provided. The process precludes cleaning of the washing machine drum prior to reusage.

BRIEF DESCRIPTION OF THE DRAWINGS

The present invention is further detailed with respect to the following drawings that are intended to show certain aspects of the present invention, but should not be construed as a limit on the practice of the present invention.

DETAILED DESCRIPTION OF THE PREFERRED EMBODIMENTS

Figure 1:
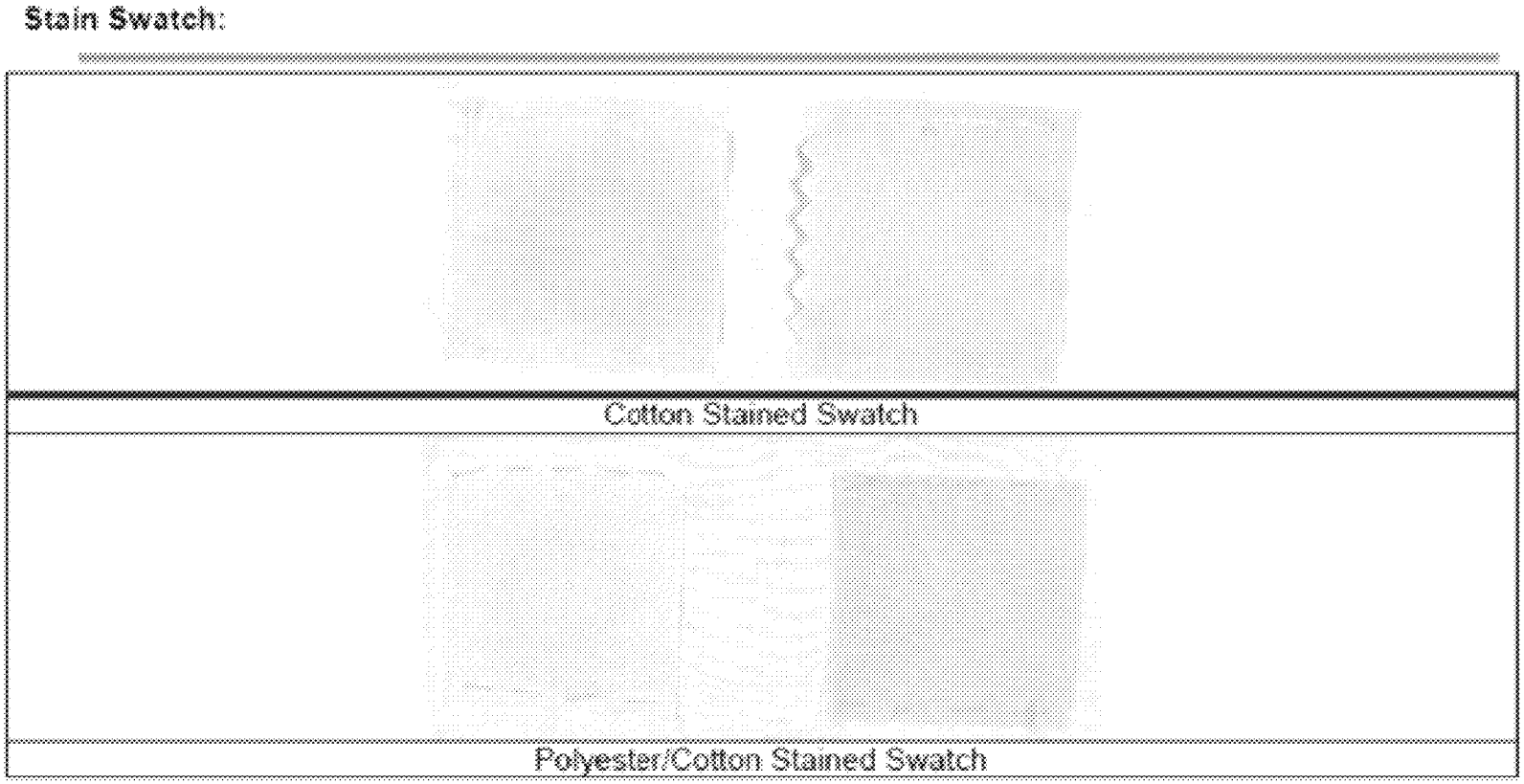
FIG. 1 are photographs of cotton stained swatch and polyester/cotton stained swatch used in performance testing of embodiments of the inventive detergent versus a leading competitor.

The present invention has utility as laundry detergent formulations formed as an aqueous blend of surfactants, enzymes, builders, and specialty additives to impart anti soil re-deposition properties so that soil does not deposit back onto other clothing or elements of the washing machine itself once soil is removed from the clothing. Embodiments of the inventive detergent formulation also contain additives with properties that impart a treatment to fabrics that inhibits future soil deposition onto the clothing with continued use. Embodiments of the inventive detergent formulation provide cleaning of heavy duty grease and automotive soils from clothing surfaces that is superior to current detergent products.

An illustrative listing of the formulary components of embodiments of the inventive heavy duty laundry detergent is provided in Table 1 with a range of concentration percentages provided.

Table 1. Inventive Exemplary Laundry Detergent Formula, where percentages are total weight percentages of additive component inclusive of carriers and inerts, with active component percentage provided in parentheses.

| Component | Proposed Function | Concentration (total weight %) Low | Nominal | High |
|---|---|---|---|---|
| water | | | Remainder | |
| (e.g. Methylisothiazolinone (80%)/Quaternium 15 | Biocide (total of all biocides) | 0.01 | 0.1 | 1.5 |
| Sodium Citrate | Builder | 0.1 | 1.8 | 6.0 |
| Borax | Builder | 0.1 | 0.9 | 3.2 |
| Ethanolamine | Builder | 0.1 | 0.5 | 2.0 |
| Linear alcohol ethoxylate | Surfactant | 3.0 | 16.0 | 22.0 |
| Alkylbenzene-Sulfonic Acid | Surfactant | 2.0 | 10.0 | 18.0 |
| Sodium dodecyl diphenyl oxide disulfonate | Surfactant | 1.8 | 7.0 | 15.5 |
| Oligoesters | Soil release polymers | 0.6 | 2.9 | 7.5 |
| Cellulase (0.001%) | Enzyme | 0.05 | 0.3 | 1.5 |
| Mannase, amylase, proteases (0.001% each) | Enzyme | 0 | 0.5 | 2 |
| Blend of nonionic esters | ester solvent | 0 | 0.9 | 7 |
| D-Limonene | Fragrance/ biocide | 0 | 1.4 | 5 |
| Polysorbate 80 | Rheological agent | 0 | 1.2 | 3 |
| Propylene Glycol | Solvent | 0 | 4.5 | 6 |
| Citric Acid | pH stabilizer | 0 | 0.5 | 8 |
| Fatty alcohol ($C_9$-$C_{15}$) alkoxylate | Surfactant | 0 | 3.5 | 14 |
| polyglucoside | Surfactant/ hydrotrope | 0 | 2.0 | 9 |

Biocides active in the present invention are provided to enhance shelf life of the formulation and limit bacterial and fungal growth. Biocides operative herein illustratively include methylisothiazolinone triclosan, triclocarbon, hydrogen peroxide, other oxygen bleach, para-chloro-metaxylenol, iodine/iodophors, selected alcohols, quaternium 15 (hexamethylenetetramine chloroallyl chloride), chlorhexidine, phenols, phospholipids, thymol, eugeniol, geraniol, oil of lemon grass, and combinations thereof. Certain quaternary surfactants may also show biocidal action and may be included as a secondary biocide agent, exemplary of these are monoalkl and dialkyl imidazolines as detailed in U.S. Pat. No. 6,838,419; alone or in combination to secondary biocides; additionally, such compounds serve as soil release compounds. Typically, a biocide or a combination of biocides are present from 0.01 to 1.5 total weight percent in an inventive formulation.

Builders in the inventive detergent formulation illustratively include inorganics of: alkali metal carbonates, borates, phosphates, bicarbonates and silicates. Specific examples of such salts include borax, acid salts, sodium and potassium tetraborates, bicarbonates, carbonates, orthophosphates, pyrophosphates, tripolyphosphates and metaphosphates; and organics of: (1) water-soluble amino carboxylates and aminopolyacetates, for example, nitrilotriacetates, glycinates, ethylenediaminetetraacetates, N-(2-hydroxyethyl)nitrilo diacetates and diethylenetriamine pentaacetates; (2) water-soluble salts of phytic acid, for example, sodium and potassium phytates; (3) water-soluble polyphosphonates, including sodium, potassium, and lithium salts of ethane-1-hydroxy-1,1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid (e.g. sodium citrate), oxydisuccinic acid, carboxymethyloxysuccinic acid, 2-oxa-1,1,3-propane tricarboxylic acid, 1,1,2,2-ethane tetracarboxylic acid, mellitic acid and pyromellitic acid; (5) water-soluble polyacetals as disclosed in U.S. Pat. Nos. 4,144,266 and 4,246,495; and (6) the water-soluble aminated alcohols such as 2-ethanolamine. Typically, a builder or a combination of builders are present from 0.3 to 11.2 total weight percent in an inventive formulation.

Enzymes in the inventive detergent formulation illustratively include enzymes for stain removal solutions that degrade a variety of common and stubborn protein, starch, mannan, pectin and grease stains, such enzymes illustratively include cellulase, mannanase, gluconase, amylase, and proteases; an enzymatic whitening solution that prevents fabric graying and maintains whiteness by disabling soil deposition on clothes and cleaving off damaged microfibrils to release trapped dirt particles that includes enzymes such as cellulase. Enzymes are individually incorporated in the detergent compositions of the present invention a level of from 0.0000005% to 0.01%, as a percentage of enzyme itself or a combination of enzymes, exclusive of carrier weight.

A solvent operative herein illustratively includes $C_4$-$C_{14}$ ethers and diethers, glycols, alkoxylated glycols, $C_3$-$C_{10}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$Ci_4$ alkyl and cycloalkyl hydrocarbons and halohydrocarbons, and mixtures thereof. An ester solvent illustratively includes benzyl acetate, acetate, 2-ethylhexyl acrylate, isopropyl stearate and diethyl malonate. Ether solvents include, for example, butyl phenyl ether, amyl phenyl ether and diphenyl ether. Ketone solvents include, for example, acetophenone. Typically, a solvent or a combination of solvents present from 0 to 7 total weight percent in an inventive formulation.

A fragrance may be added to embodiments of the inventive detergent illustratively including D-Limonene which is the major component of the oil extracted from citrus rind or other aromatic plant extracts. Typically, a fragrance is present from 0 to 5 total weight percent in an inventive formulation. It is appreciated that a fragrance may also have secondary solvent or biocide properties.

A rheological agent operative herein illustratively includes polysorbate 80, methylcellulose, hydroxypropylmethylcellulose, xanthan gum, guar gum and hydroxypropyl guar gum, succinoglycan, and trihydroxystearin. Typically, a rheological agent is present from 0 to 3 total weight percent in an inventive formulation.

A pH stabilizer may be added to embodiments of the inventive detergent and illustratively include citric acid, mineral acids, and combinations thereof. Typically, a pH stabilizer is present from 0 to 8 total weight percent in an inventive formulation.

Surfactants that may be added to embodiments of the inventive detergent illustratively include alkylbenzene sulfonates, ($C_{12}$ (Branched) Sodium Diphenyl Oxide Disulfonate), alcohol ethoxylates, alkyl polyglycoside, alcohol ethoxylates based on a $C_{9-11}$ synthetic alcohol), and combinations thereof.

Embodiments of the inventive detergent may also use sulfonic acid as part of the formulation, where sulfonic acids are often soluble in water or exhibit detergent-like properties.

It has been surprisingly found that the inclusion of a soil release polymer in embodiments of the inventive detergent impart anti soil re-deposition properties so that soil does not deposit back onto other clothing or elements of the washing unit itself once soil is removed from the clothing. A soil release polymer operative herein is a non-ionic soil release/antistatic agent for the treatment of 100% polyester fabrics and polyester rich blends. The soil release polymers operative herein are oligoesters. These oligoesters are condensation products of at least two of: dimethyl terephthalate, ethylene glycol, propylene glycol, polyalkylene glycols, and combinations thereof alone or with other monomers. As a consequence of a molar excess of the alcohol component, these oligoesters contain terminal OH groups which may, wholly or in part, be terminated by alkoxy groups (end-caps). Oligoesters are further detailed in U.S. Pat. No. 4,116,885; and U.S. Pat. No. 4,210,417. An inventive soil release polymer imparts hydrophilic/oleophobic effect to fibers such as polyester and acts to lower soil redeposition.

Without intended to be bound to a particular theory, an inventive soil release polymer surrounds the polyester fiber with an envelope which alters the hydrophobic nature of the fiber surface. The altered fiber is able to absorb water between the fiber and the inventive soil release polymer layer, and interfacial tension between oil and fiber is increased, making oil more easily removable. After treatment, treated fibers exhibit higher conductivity, and the tendency to build-up static electricity is reduced. The generally more oleophobic nature of the inventive soil release polymer treated fiber makes it easier to remove oily and/or particulate contamination by washing.

Embodiments of an inventive detergent formulation have the property of storage stability for at least 4 months. pH storage stability is defined as a change in composition pH as measured at standard temperature and pressure that deviates less than one pH unit when the composition is stored at standard temperature and pressure. In an embodiment standard temperature is defined as 20° Celsius.

The present invention achieves storage stability while maintaining conventional cleaning properties with respect to heavy duty grease and automotive soils. Through selection of specific additives, an inventive cleaning composition is readily formulated for heavy duty grease and automotive soils to impart anti soil re-deposition properties so that soil does not deposit back onto other clothing or elements of the washing unit itself once soil is removed from the clothing.

The present invention is further detailed with respect to the following nonlimiting examples. Unless otherwise specified, the percentages detailed herein are total weight percent of the inventive formulation.

Example 1

A blind comparison was performed in accordance with ASTM D4265-14 Standard Guide for Evaluating Stain Removal Performance in Home Laundering by an independent testing lab of the nominal formulation of Table 1 versus a leading detergent available on the market in the form of laundry detergent samples. Tests results confirmed comparable performance between an embodiment of the inventive detergent formulation and the leading detergent.

Two (each) 5 cm×5 cm Pre-Stained Cotton and Polyester/Cotton Swatches on Cotton and Polyester/Cotton monitors as shown in FIG. 1, respectively, were used (see stain descriptions below) to evaluate the stain removal performance of the submitted liquid laundry detergents.

Color measurement(s) of the unstained fabric area were taken prior to cleaning using a spectrophotometer, measuring on the L*a*b* color scale.

The stained monitors (1 per load/detergent) were washed with ballast fabric (100% cotton and 50:50 Polyester:Cotton) to simulate consumer use—a large or "full wash load."

Color measurement(s) of each stained swatch were then evaluated after each cleaning cycle using a spectrophotometer, measuring on the L*a*b* color scale.

Residual Stain Index (RSI) was then calculated using the following formula:

$$RSI = 100 - \Delta E^*_{(WS-UF)}$$

$$\Delta E^* = \sqrt{\Delta L^{*2} + \Delta a^* + \Delta b^{*2}}$$

$RSI$ = Residual Stain Index $UF$ = Unwashed(unstained) fabric area $WS$ = Washed Stain area $\Delta E^*_{(WS-UF)}$ =

Color difference between the washed stain and the unwashed fabric

This process was repeated two (2) additional times for a total of three (3) replicates per product per fabric type.

Manual Cleaning Performance Test:

| 1. Test Conditions: | |
|---|---|
| Test Swatches[1]-Soil(s): | 100% Cotton Stained Swatches on 100% Cotton Monitor<br>50:50 Polyester:Cotton Stained Swatches on 50:50 Polyester:Cotton Polyester Monitor |
| Ballast Fabric(s): | 100% Cotton Standard Ballast Sheets<br>50:50 Polyester:Cotton Standard Ballast Sheets |
| Fabric Load: | 2.7 kg of fresh ballast per wash cycle (replicate) |
| Detergent Concentration: | As per the instruction of the client the following detergent amounts were used for testing:<br>60 mL of Laundry Detergent A-Invention<br>60 mL of Laundry Detergent B-Comparative of Table 2 |
| Water Hardness: | 120 ppm |
| Water Temperature: | 82 ± 2° F. (Warm Cycle)<br>Ambient Rinse |
| Washer Type: | Top loading washer |
| Washer Settings: | Normal/Casual cycle |
| Dryer Settings: | Normal Setting (160 ± 10° F. or 71.1 ± 6° C.) for 45 minutes |

[1]All test swatches were stored in the dark prior to use and after removal from dryer until the final evaluation was performed.

The following tables summarize the test results:

TABLE 2

| Total Average Residual Stain Index (RSI) | | | | |
|---|---|---|---|---|
| Detergent | Laundry Detergent A P44-12-19-14-1A | | Laundry Detergent B P44-12-19-14-1B | |
| Fabric | Cotton | Polyester/Cotton | Cotton | Polyester/Cotton |
| Total Average RSI | 88.83 | 90.11 | 87.24 | 89.58 |

TABLE 3

| 100% Cotton Results: | | | | |
|---|---|---|---|---|
| Laundry Detergent A P44-12-19-14-1A | | | | |
| | Residual Stain Index (RSI) | | | |
| Stain Description | Run 1 | Run 2 | Run 3 | Average |
| Dirty Motor Oil | 82.51 | 83.60 | 82.23 | 82.78 |
| Sebum with Dust | 94.95 | 95.12 | 94.60 | 94.89 |
| | | | Total Average RSI: | 88.83 |
| Laundry Detergent B P44-12-19-14-1B | | | | |
| | Residual Stain Index (RSI) | | | |
| Stain Description | Run 1 | Run 2 | Run 3 | Average |
| Dirty Motor Oil | 81.26 | 80.85 | 82.17 | 81.43 |
| Sebum with Dust | 92.85 | 92.97 | 93.31 | 93.04 |
| | | | Total Average RSI: | 87.24 |

TABLE 4

| 50:50 Polyester:Cotton Results: | | | | |
|---|---|---|---|---|
| Laundry Detergent A P44-12-19-14-1A | | | | |
| | Residual Stain Index (RSI) | | | |
| Stain Description | Run 1 | Run 2 | Run 3 | Average |
| Dirty Motor Oil | 90.16 | 85.83 | 86.27 | 87.42 |
| Sebum with Dust | 92.74 | 92.43 | 93.25 | 92.81 |
| | | | Total Average RSI: | 90.11 |
| Laundry Detergent B P44-12-19-14-1B | | | | |
| | Residual Stain Index (RSI) | | | |
| Stain Description | Run 1 | Run 2 | Run 3 | Average |
| Dirty Motor Oil | 85.03 | 86.06 | 86.41 | 85.83 |
| Sebum with Dust | 93.26 | 93.15 | 93.57 | 93.33 |
| | | | Total Average RSI: | 89.58 |

Example 2

Figure 2:
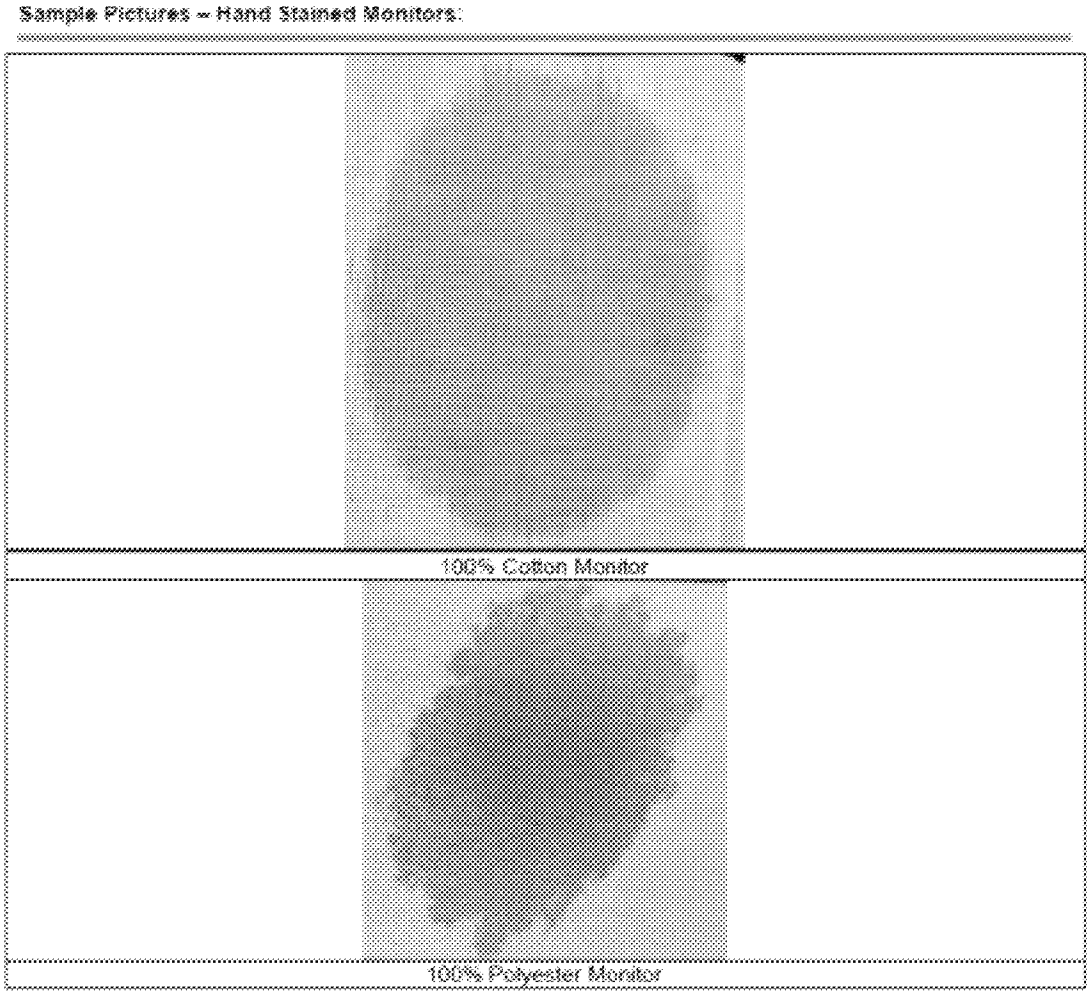
FIG. 2 shows hand stained monitors on cotton and polyester used in performance testing of embodiments of the inventive detergent versus a leading competitor.

A blind comparison was performed in accordance with ASTM D4265-14 Standard Guide for Evaluating Stain Removal Performance in Home Laundering by an independent testing lab of the nominal formulation of Table 1 versus a leading detergent available on the market in the form of laundry detergent samples and pre-spotter samples with hand applied dirty motor oil as shown in FIG. 2. The conventional detergent lacks an oligoester of the present invention and includes the following ingredients.

TABLE 5

| Comparative conventional stain release detergent formulation lacking an oligoester. | |
|---|---|
| Ingredient | Purpose |
| Water | Process aid |
| Sodium alcoholethoxy sulfate | Surfactant |
| Linear alkylbenzene sulfonate, sodium/MEA salts | Surfactant |
| MEA citrate | Captures soil |
| Propylene glycol | Process aid |
| Polyethyleneimine ethoxylate | Polymer |
| Ethanol | Process aid |
| Diethylene glycol | Process aid |
| Polyethyleneimine propoxyethoxylate | Polymer |
| Sodium fatty acids | Surfactant |
| Protease | Enzyme |
| Borax | Captures soil |
| Sodium cumene sulfonate | Process aid |
| DTPA (diethylene triamine pentaacetic acid-chelant) | Captures soil |
| Fragrance | Scent |
| Amylase | Enzyme |
| Disodium diaminostilbene disulfonate | Brightener |
| Calcium formate | Process aid |
| Sodium formate | Process aid |
| Gluconase | Enzyme |
| Dimethicone | Process aid |
| Liquitint Blue | Colorant |
| Mannanase | Enzyme |

Tests results confirmed comparable performance between inventive detergent formulation and the leading detergent.

- Five (each) hand-applied dirty motor oil stains (0.5 mL of 50:50 dirty motor oil:tetradecane was deposited in the center of a 1.75" diameter staining ring on the fabric) on Cotton, Polyester, Polyester/Cotton, and *Nylon Blend monitors were used to evaluate the stain removal performance of the submitted pre-spotters.
  *Nylon Blend—90:10 Nylon:Spandex
- Color measurements of the unstained fabrics were taken using a spectrophotometer, measuring on the L*a*b* scale.
- One mL of prespotter was applied to each stain and allowed to absorb for five minutes prior to washing.
- The stained monitors (1 per load/detergent) were washed with ballast fabric (100% Cotton, 100% Polyester, 50:50 Polyester:Cotton, and a mixed (5:1) ballast load of Polyester:Nylon Blend* to simulate consumer use—a large or "full wash load."
- The stained monitors were washed with 50 g of AATCC Standard Detergent without Optical Brighteners.
- Color measurement(s) of each stain were then evaluated after each cleaning cycle using a spectrophotometer, measuring on the L*a*b* color scale.
- Residual Stain Index (RSI) was then calculated using the following formula:

$$RSI = 100 - \Delta E^*_{(WS-UF)}$$

$$\Delta E^* = \sqrt{\Delta L^{*2} + \Delta a^* + \Delta b^{*2}}$$

$RSI$ = Residual Stain Index $UF$ = Unwashed(unstained) fabric area $WS$ = Washed Stain area $\Delta E^*_{(WS-UF)}$ =

Color difference between the washed stain and the unwashed fabric

This process was repeated two (2) additional times for a total of three (3) replicates per product perfabric type.

Manual Cleaning Performance Test:

| 2. Test Conditions: | |
|---|---|
| Test Swatches-Soil(s): | 100% Cotton Monitor<br>100% Polyester Monitor<br>50:50 Polyester/Cotton Monitor<br>Nylon Blend (90:10 Nylon:Spandex) Monitor |
| Ballast Fabric(s): | 100% Cotton Standard Ballast Sheets<br>100% Polyester Standard Ballast Sheets<br>50:50 Polyester:Cotton Standard Ballast Sheets<br>Mixed Ballast Load-5:1 100% Polyester Standard Ballast<br>Sheets:Nylon Blend (90:10 Nylon:Spandex) Ballast Sheets |
| Fabric Load: | 2.7 kg of fresh ballast per wash cycle (replicate) |
| Prespotter Concentration: | 1 mL of Pre-Spotter A P44-12-19-14-2A per stain - Invention<br>1 mL of Pre-Spotter B P44-12-19-14-2B per stain - Competitor |
| Detergent Concentration: | 50g of AATCC Standard Detergent without Optical Brighteners |
| Water Hardness: | 120 ppm |
| Water Temperature: | 82 ± 2° F. (Warm Cycle) |
| Washer Type: | Ambient Rinse |
| Washer Settings: | Top loading washer |
| Dryer Settings: | Normal/Casual cycle |
| | Normal Setting (160 ± 10° F. or 71.1 ± 6° C.) for 45 minutes |

[1]All test swatches were stored in the dark prior to use and after removal from dryer until the final evaluation was performed.

The following tables summarize the test results:

TABLE 6

| Test Results: Total Average Residual Stain Index (RSI) | | | | | | | |
|---|---|---|---|---|---|---|---|
| Pre-Spotter A P44-12-19-14-2A | | | | Pre-Spotter B P44-12-19-14-2B | | | |
| Cotton | Polyester | Polyester/Cotton | Nylon Blend | Cotton | Polyester | Polyester/Cotton | Nylon Blend |
| 95.59 | 99.15 | 97.08 | 89.73 | 93.67 | 98.58 | 97.58 | 90.48 |

TABLE 7

100% Cotton Results:

Pre-Spotter A P44-12-19-14-2A

| Stain Description | Residual Stain Index (RSI) Run 1 | Run 2 | Run 3 | Average |
|---|---|---|---|---|
| Dirty Motor Oil (1) | 97.06 | 96.55 | 95.32 | 96.34 |
| Dirty Motor Oil (2) | 96.07 | 96.19 | 95.45 | 95.96 |
| Dirty Motor Oil (3) | 95.47 | 94.49 | 94.56 | 94.84 |
| Dirty Motor Oil (4) | 95.46 | 95.64 | 95.16 | 95.44 |
| Dirty Motor Oil (5) | 95.61 | 95.25 | 95.34 | 95.40 |
| | | | Total Average RSI: | 95.59 |

Pre-Spotter B P44-12-19-14-2B

| Stain Description | Residual Stain Index (RSI) Run 1 | Run 2 | Run 3 | Average |
|---|---|---|---|---|
| Dirty Motor Oil (1) | 95.04 | 92.99 | 93.62 | 93.88 |
| Dirty Motor Oil (2) | 94.31 | 93.33 | 93.34 | 93.63 |
| Dirty Motor Oil (3) | 94.51 | 93.13 | 92.89 | 93.51 |

TABLE 7-continued

100% Cotton Results:

| | | | | |
|---|---|---|---|---|
| Dirty Motor Oil (4) | 94.08 | 94.47 | 93.02 | 93.86 |
| Dirty Motor Oil (5) | 93.77 | 93.20 | 93.39 | 93.45 |
| | | | Total Average RSI: | 93.67 |

TABLE 8

100% Polyester Results:

Pre-Spotter A P44-12-19-14-2A

| Stain Description | Residual Stain Index (RSI) Run 1 | Run 2 | Run 3 | Average |
|---|---|---|---|---|
| Dirty Motor Oil (1) | 99.81 | 98.87 | 98.92 | 99.20 |
| Dirty Motor Oil (2) | 99.35 | 99.11 | 99.03 | 99.16 |
| Dirty Motor Oil (3) | 99.68 | 99.21 | 98.65 | 99.18 |
| Dirty Motor Oil (4) | 99.65 | 99.33 | 98.38 | 99.12 |
| Dirty Motor Oil (5) | 99.56 | 99.28 | 98.40 | 99.08 |
| | | | Total Average RSI: | 99.15 |

Pre-Spotter B P44-12-19-14-2B

| Stain Description | Residual Stain Index (RSI) Run 1 | Run 2 | Run 3 | Average |
|---|---|---|---|---|
| Dirty Motor Oil (1) | 99.18 | 98.38 | 98.29 | 98.62 |
| Dirty Motor Oil (2) | 99.26 | 97.44 | 98.27 | 98.32 |
| Dirty Motor Oil (3) | 99.29 | 98.59 | 98.73 | 98.87 |
| Dirty Motor Oil (4) | 98.84 | 98.75 | 98.36 | 98.65 |
| Dirty Motor Oil (5) | 98.88 | 98.47 | 97.97 | 98.44 |
| | | | Total Average RSI: | 98.58 |

TABLE 9

50:50 Polyester:Cotton Results:

Pre-Spotter A P44-12-19-14-2A

| Stain Description | Residual Stain Index (RSI) Run 1 | Run 2 | Run 3 | Average |
|---|---|---|---|---|
| Dirty Motor Oil (1) | 97.21 | 97.49 | 96.64 | 97.11 |
| Dirty Motor Oil (2) | 97.92 | 97.44 | 97.26 | 97.54 |
| Dirty Motor Oil (3) | 98.03 | 96.66 | 97.35 | 97.35 |
| Dirty Motor Oil (4) | 97.50 | 95.75 | 97.52 | 96.92 |
| Dirty Motor Oil (5) | 96.72 | 95.59 | 97.09 | 96.47 |
| | | | Total Average RSI: | 97.08 |

Pre-Spotter B P44-12-19-14-2B

| Stain Description | Residual Stain Index (RSI) Run 1 | Run 2 | Run 3 | Average |
|---|---|---|---|---|
| Dirty Motor Oil (1) | 97.65 | 97.50 | 97.80 | 97.65 |
| Dirty Motor Oil (2) | 97.33 | 97.70 | 97.30 | 97.44 |
| Dirty Motor Oil (3) | 97.56 | 97.65 | 97.87 | 97.69 |
| Dirty Motor Oil (4) | 97.33 | 97.50 | 98.10 | 97.64 |
| Dirty Motor Oil (5) | 97.32 | 97.08 | 97.98 | 97.46 |
| | | | Total Average RSI: | 97.58 |

TABLE 10

| 95:5 Nylon:Spandex Results: | | | | |
|---|---|---|---|---|
| Pre-Spotter A P44-12-19-14-2A | | | | |
| | Residual Stain Index (RSI) | | | |
| Stain Description | Run 1 | Run 2 | Run 3 | Average |
| Dirty Motor Oil (1) | 90.70 | 88.82 | 91.03 | 90.18 |
| Dirty Motor Oil (2) | 89.93 | 88.51 | 91.01 | 89.82 |
| Dirty Motor Oil (3) | 90.47 | 87.87 | 89.69 | 89.34 |
| Dirty Motor Oil (4) | 90.63 | 88.67 | 89.83 | 89.71 |
| Dirty Motor Oil (5) | 89.29 | 88.76 | 90.75 | 89.60 |
| | | | Total Average RSI: | 89.73 |
| Pre-Spotter B P44-12-19-14-2B | | | | |
| | Residual Stain Index (RSI) | | | |
| Stain Description | Run 1 | Run 2 | Run 3 | Average |
| Dirty Motor Oil (1) | 90.80 | 90.63 | 90.37 | 90.60 |
| Dirty Motor Oil (2) | 90.65 | 90.48 | 90.17 | 90.43 |
| Dirty Motor Oil (3) | 90.55 | 90.52 | 90.08 | 90.38 |
| Dirty Motor Oil (4) | 90.72 | 90.44 | 90.27 | 90.48 |
| Dirty Motor Oil (5) | 90.54 | 90.81 | 90.18 | 90.51 |
| | | | Total Average RSI: | 90.48 |

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A process for cleaning clothing having soil thereon in a washing machine comprising:

applying a formulation into the washing machine with the clothing, the formulation comprising:
- one or more builders;
- one or more enzymes;
- one or more surfactants;
- a solvent comprising propylene glycol in the amount of about 5 w %;
- a biocide;
- a soil release polymer of a nonionic oligoester present from 0.6 to 5.5 total weight percent; and
- water forming a majority of the formulation; and allowing sufficient time for the formulation to clean the clothing during operation of the washing machine without redeposition of the soil back onto the clothing or the washing machine once the soil is removed from the clothing.

2. The process of claim 1 wherein the formulation is monophasic for at least 4 months storage at 20° Celsius as measured by a change of less than one pH unit.

3. The process of claim 1 wherein the one or more builders further comprises sodium citrate.

4. The process of claim 1 wherein said one or more builders further comprises at least one of borax or ethanolamine.

5. The process of claim 1 wherein said one or more enzymes comprises cellulase.

6. The process of claim 1 wherein said one or more surfactants comprises at least one of alkylbenzene sulfonate, alkyldiphenyl disulfonate, or linear alcohol ethoxylate.

7. The process of claim 1 wherein said solvent further comprises an ester solvent.

8. The process of claim 1 wherein said solvent further comprises a mixture of nonionic esters.

9. The process of claim 1 wherein the applied formulation further comprises a fragrance.

10. The process of claim 1 wherein the applied formulation further comprises a rheology agent.

11. The process of claim 1 wherein said soil release polymer further comprises a condensation products of at least two of: dimethyl terephthalate, ethylene glycol, propylene glycol, and polyalkylene glycols.

* * * * *